US005401225A

United States Patent [19]

Ko

[11] Patent Number: 5,401,225

[45] Date of Patent: Mar. 28, 1995

[54] WEIGHT AND HOLDING TRAINING DEVICE

[76] Inventor: Ching Ho Ko, P.O. Box No. 2103, Hsien Hsi Hsiang, Chang Hua Hsien, Taichung, Taiwan, Prov. of China

[21] Appl. No.: 216,065

[22] Filed: Mar. 22, 1994

[51] Int. Cl.[6] ..... A63B 23/16; A63B 21/06; A63B 21/02

[52] U.S. Cl. ..... 482/50; 482/108; 482/121

[58] Field of Search ..... 482/49, 50, 106–109, 482/121–130

[56] References Cited

U.S. PATENT DOCUMENTS 742,393 2/1902 Chellis et al. ..... 482/50

1,138,459 5/1915 Day ..... 482/108

*Primary Examiner*—Richard J. Apley

*Assistant Examiner*—John Mulcahy

[57] ABSTRACT

A weight and holding training device for both weight training and holding training mainly comprises two sets of end casings 1, a balance weight element 2 and an elastic element 3. In which, the balance weight element and the elastic element are embedded into the end casings so as to be fixed firmly. Consequently, a close-loop frame is formed. This close-loop frame provides a space within the frame that allowing the elastic element to deform. Thus, both functions of weight training and holding training can be achieved.

6 Claims, 4 Drawing Sheets

WEIGHT AND HOLDING TRAINING DEVICE

BACKGROUND OF THE INVENTION

The present invention relates to a training device. More specifically, the present invention relates to a weight and holding training device which has both weight training and holding training functions.

Most typical small-sized weight training devices for arm training are dumbbells. But a dumbbell is generally designed for weight training only. It does not have a holding training function. Therefore, if a user wants to do some holding training, this user has to buy a holding training device. Under this circumstance, it not only wastes the money to buy a holding training device, but also wastes the time to change the training devices. A person cannot use the weight training device and the holding training device simultaneously, so this person may need to change the device quite often. As a result, it wastes time.

SUMMARY OF THE INVENTION

The present invention is to solve the above-mentioned problems. The primary object of the present invention is to provide a safe weight and holding training device which would achieve both weight training function and holding training function by utilizing an elastic element, a balance weight and two sets of end casings as to form a close-loop frame. Furthermore, the elastic element is mainly constructed by a spiral spring or the likes.

The both ends of the elastic element and the both ends of the balance weight element are embedded into the two sets of end casing. Thus, the close-loop frame can be formed.

The second object of the invention is to use a smaller sized spring with a smaller spring diameter by using a curved elastic element and the element's two ends are fixed, because the pre-curved shape can increase its elasticity.

The invention is to provide a weight and holding training device which mainly comprises two sets of end casing, a balance weight element and an elastic element.

Regarding the two sets of end casings, each set of the end casings is composed of a pair of half casings and forms a substantially hollow structure by assembling said half casings' hollow sides together. The two sets of end casings are facing each other. Each set of the end casings has two openings on the facing side of said two sets of end casings. The two openings are separated by a predetermined distance.

Concerning the balance weight element, it is substantially bacillary with predetermined weight. Both ends of the balance weight element protrude into the corresponding openings of the two sets of end casings. Thus, it can be fixed.

The elastic element is a spiral spring with predetermined resilience. Both ends of the elastic element protrude into the other corresponding openings of the two sets of end casings. Thus, it can be fixed. The elastic element is flexible.

The aforesaid elastic element and balance weight element are assembled with the two sets of end casings and then form a close-loop frame. A distance is set between the elastic element and the balance weight element. The distance allows the elastic element to deform while a user is holding these two elements.

Such deformation further creates a resisting force against the user's hand or fingers simultaneously so that both functions of weight training and holding training can be achieved.

DETAILED DESCRIPTION OF THE PREFERRED EMBODIMENT

Figure 1:
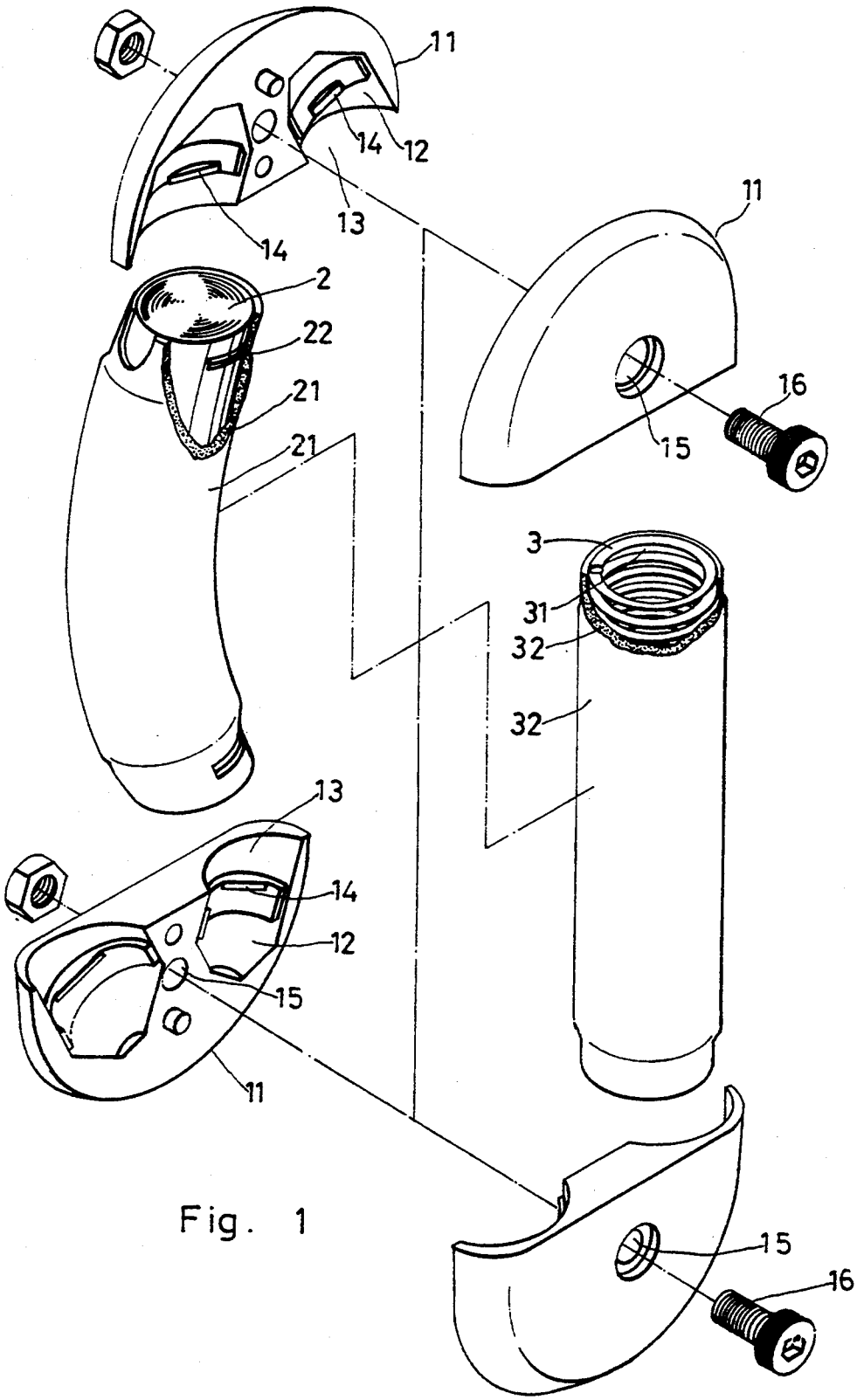
FIG. 1 is an exploded view of the present invention.
Figure 2:
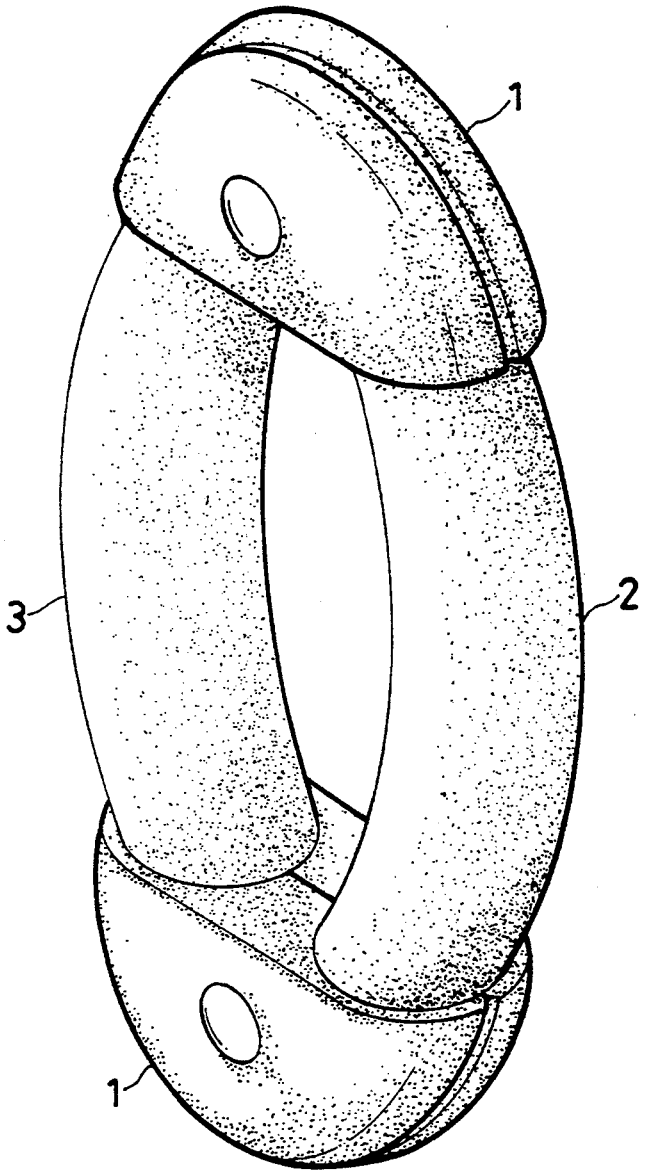
FIG. 2 is a perspective view of the present invention.
Figure 3:
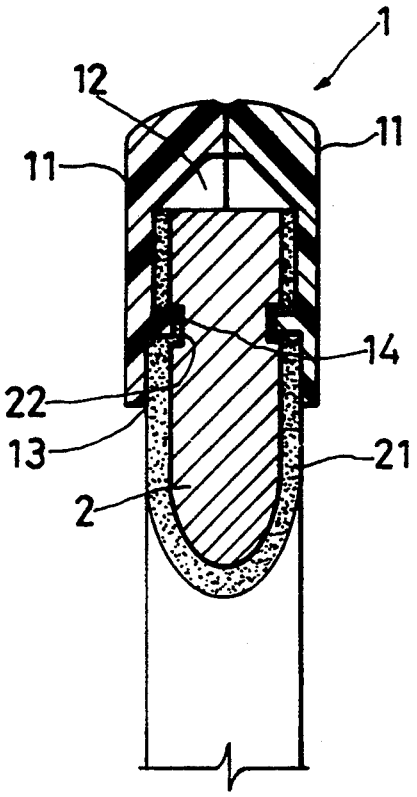
FIG. 3 is a cross-sectional view of the combination portion of the balance weight element and the end casing.

Please refer to FIGS. 1 to 4. The present invention entitled "A weight and holding training device" has two sets of end casings 1. Each set of the end casings 1 is composed of a pair of half casings 11 and forming a substantially hollow structure by assembling said half casings' hollow sides together. The two sets of end casings 1 are facing each other. Each set of the end casings 1 has two openings 12 on the facing side of said two sets of end casings 1. These two openings 12 are separated by a predetermined distance. Each of said openings 12 has an hole portion 13 and a stop flange 14 inside. The hole portions 13 are located between the facing sides of the two sets of end casings 1. Each half casing 11 has a through fixing hole 15, so that the half casings 11 of these two sets of end casings 1 are assembled by the through fixing holes 15 and screws 16.

Between the two sets of end casing 1, there is a balance weight element 2 which is substantially curved bacillary with predetermined weight. A pipe 21 made of plastic foam for better holding is covered on the balance weight 2. Both ends of the balance weight element 2 protrude into one corresponding hole portions 13 of said two sets of end casings 1. Each end of the balance weight 2 has two recesses 22 for locking the corresponding stop flanges 14 inside the opening 12. Moreover, every stop flange 14 and every recess 22 are perpendicular to the axis of said elastic element 2.

Figure 4:
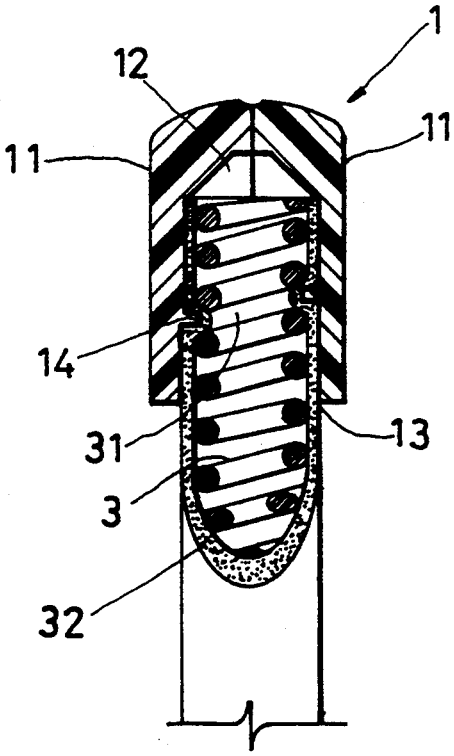
FIG. 4 is a cross-sectional view of the combination portion of the elastic element and the end casing.

Between the two sets of end casing 1, there is an elastic element 3 which is a spiral spring with predetermined resilience. Both ends of said elastic element 3 protruding into the other corresponding hole portions 13 of said two sets of end casings 1 and to be fixed by stop flanges 14. The stop flanges 14 protrudes into the gaps 31 between two predetermined adjacent spring coils as shown in FIG. 4. So the elastic element 3 is flexible because it is formed by a spring. After bending the elastic element 3, the elastic element 3 becomes curve, the distance from the top to the end of the elastic element 3 is equal to the distance from the top to the end of the balance weight element 2.

According to the aforesaid elastic element 3 and the balance weight element 2, they are assembled with said sets of end casings 1 and forming a close-loop frame. A distance is set between the elastic element 3 and the balance weight element 2. Please refer to FIG. 5. The distance allows the elastic element 3 to deform while a user is holding said two elements 2 & 3. Such deformation further creating a resisting force against the user's hand or fingers simultaneously so that both functions of weight training and holding training can be achieved.

Above description is just the first preferred embodiment of the invention. Practically, after installing the elastic element 3 and the balance weight element 2, the first preferred embodiment is formed as a close-loop frame. However, it is feasible to form a rectangular frame, circular frame, or any other proper close-loop frames.

Figure 5:
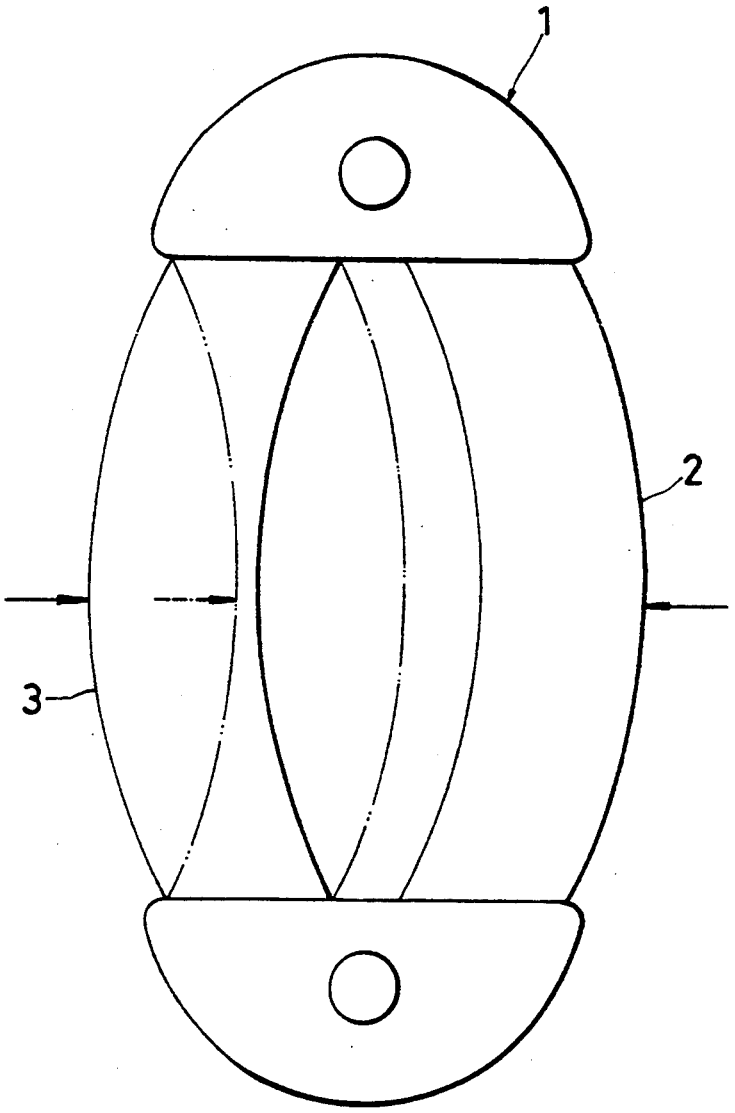
FIG. 5 illustrates the deformation situation of the present invention in use.

Of course, the exercising method is not limited to the holding deformation as shown in FIG. 5. Another way for exercising the device is to swing this device by arm. While a user's hand holds the elastic element 3 and swings the device by arm, the weight training function can be achieved.

I claim:

1. A weight and holding training device comprises:

two sets of end casings, each set of the end casings being composed of a pair of half casings and forming a substantially hollow structure by assembling said half casings' hollow sides together, said two sets of end casings being facing each other, each set of the end casings having two openings on the facing side of said two sets of end casings, said two openings being separated by a predetermined distance;

a balance weight element being substantially bacillary with predetermined weight, both ends of said balance weight element protruding into the corresponding openings of said two sets of end casings so as to be fixed;

an elastic element being a spiral spring with predetermined resilience, both ends of said elastic element protruding into the other corresponding openings of said two sets of end casings so as to be fixed, said elastic element being flexible;

aforesaid elastic element and balance weight element being assembled with said two sets of end casings and forming a close-loop frame, a distance being set between said elastic element and said balance weight element, the distance allowing said elastic element to deform while a user is holding said two elements, said deformation further creating a resisting force against said user's hand or fingers simultaneously so that both functions of weight training and holding training can be achieved.

2. A weight and holding training device as claimed in claim 1, wherein each of said end casings has two separated hollow portions, each of said hollow portions having an opening and a stop flange, every stop flange being perpendicular to the axis of said elastic element and to the axis of said balance weight element, said balance weight element and said elastic element both having recesses for embedding said stop flanges, and said recesses being located in a preset position near their protruding ends to precisely lock the corresponding stop flanges.

3. A weight and holding training device as claimed in claim 1, wherein said half casings of these two sets of end casings are assembled by through fixing holes and screws.

4. A weight and holding training device as claimed in claim 1, wherein said balance weight element and said elastic element are covered by pipes correspondingly for easier and more comfortable holding.

5. A weight and holding training device as claimed in claim 4, wherein said pipes are made of plastic foam material.

6. A weight and holding training device as claimed in claim 1, wherein said balance weight element is a curved rod and said elastic element is also curved; the distance from the top to the bottom of said elastic element being equal to the distance from the top to the bottom of said balance weight after bending the elastic element; whereby, after assembling the balance weight rod and the elastic element with said sets of the end casings, the balance weight rod and the elastic element being both curved outwardly thus making their middle portions separate by a maximum distance.

* * * * *